US008584865B2

(12) United States Patent
Lange

(10) Patent No.: US 8,584,865 B2
(45) Date of Patent: Nov. 19, 2013

(54) SCREEN

(75) Inventor: Werner Lange, Nattheim (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/240,566

(22) Filed: Sep. 22, 2011

(65) Prior Publication Data

US 2012/0031816 A1 Feb. 9, 2012

Related U.S. Application Data

(63) Continuation of application No. PCT/EP2010/052312, filed on Feb. 24, 2010.

(30) Foreign Application Priority Data

Mar. 27, 2009 (DE) ..... 10 2009 015 405

(51) Int. Cl.
*B07B 1/00* (2006.01)

(52) U.S. Cl.
USPC ..... 209/273; 209/305; 209/397

(58) Field of Classification Search
USPC ..... 209/17, 273, 305, 306, 397; 210/413–415, 498, 512.1
See application file for complete search history.

(56) References Cited

U.S. PATENT DOCUMENTS

| | | | | | |
|---|---|---|---|---|---|
| 1,916,393 | A | * | 7/1933 | Smith | 209/397 |
| 3,617,008 | A | * | 11/1971 | Lamort | 241/88 |
| 4,276,159 | A | * | 6/1981 | Lehman | 209/273 |
| 4,529,520 | A | * | 7/1985 | Lampenius | 210/498 |
| 4,717,471 | A | | 1/1988 | Winkler | |
| 5,073,254 | A | * | 12/1991 | Beisenherz et al. | 209/273 |
| 5,638,960 | A | * | 6/1997 | Beuermann et al. | 209/397 |
| 6,092,286 | A | * | 7/2000 | Lange | 29/896.62 |
| RE39,940 | E | * | 12/2007 | Frejborg et al. | 210/232 |
| 8,267,255 | B2 | * | 9/2012 | Kinuta | 209/397 |
| 2004/0004032 | A1 | * | 1/2004 | Burger et al. | 209/233 |

FOREIGN PATENT DOCUMENTS

| | | |
|---|---|---|
| DE | 29608938 U1 | 9/1996 |
| WO | 03033152 A1 | 4/2003 |

OTHER PUBLICATIONS

International Search Report for Application Serial No. PCT/EP2010/052312, dated Apr. 12, 2010. (4 pgs ).

* cited by examiner

*Primary Examiner* — Joseph C Rodriguez
(74) *Attorney, Agent, or Firm* — Taylor IP, P.C.

(57) ABSTRACT

The invention relates to a strainer for treating a fibrous material suspension suitable for producing a paper, cardboard, tissue, or other fibrous material web, having a plurality of strainer perforations, the smallest cross-sectional areas of which are approximately of the same size. The sorting effect and the throughput are to be improved such that the cross-sectional areas of the strainer perforations on the inflow side have varying size.

18 Claims, 1 Drawing Sheet

SCREEN

CROSS REFERENCE TO RELATED APPLICATIONS

This is a continuation of PCT application No. PCT/EP2010/052312, entitled "STRAINER", filed Feb. 24, 2010, which is incorporated herein by reference.

BACKGROUND OF THE INVENTION

1. Field of the Invention

The present invention relates to a screen for treating a fibrous stock suspension suitable for producing a paper, cardboard or tissue or other fibrous material web, the screen having a plurality of screen perforations, the smallest cross sectional areas of which are approximately of the same size.

2. Description of the Related Art

Screens of this type are used preferably for wet-screening of fibrous stock suspensions in order to remove contaminants contained therein. As a rule, they are rigid and thereby differentiate themselves from flexible endless screens which are used in screen presses and paper machines. The characteristic of such a screen essentially results from the size, shape and number of screen perforations contained therein. As a rule, these are kept smaller than the substances which are to be screened out. Such screens are advantageously utilized, for example, in pulpers, secondary pulpers and sorters for the preparation of paper fiber suspensions, whereby they are intended to hold back contaminants. In applications which arise in particular in the paper and pulp industry, screens of this type should have screening properties which are attainable through round perforations between 1 and 30 millimeters (mm), depending on the coarseness of the stocks. Of course, one also strives to enable an as great as possible throughput through such screens, meaning that a volume as great as possible of non-rejected substances passes through the perforations. This can be supported in that as many perforations as possible are provided. In general terms, as large as possible an open screen area relative to the overall surface of the screen element is strived for.

An additional requirement is a relatively high rigidity against hydraulic pressure. Such screen elements are utilized in a production operation where occasional break-downs are encountered, which leads to varying and considerable pressure load on the screen elements. Since clogging cannot always be eliminated, high pressures, and with appropriately large surfaces, also high forces can definitely act upon the surface of such screen elements. These increased forces must be absorbed by the screen without any damage occurring.

What is needed in the art is to improve the screening effect and/or the throughput while ensuring the necessary stability.

SUMMARY OF THE INVENTION

The present invention provides a screen having a plurality of perforations, the smallest cross-sectional areas of which are approximately the same size and the cross-sectional area of the screen perforations on the inflow side is of varying size. This allows with relatively low expenditure to increase the open area of the screen through a relatively compact arrangement of the screen perforations, without substantially impairing the stability of the screen. This leads to an increase in throughput, thereby positively effecting the energy consumption. At the same throughput the screen according to the present invention also permits smaller minimal screen perforations to improve the screening effect.

Screens which are to be used to treat fibrous stock suspensions must have a sufficient wall thickness for reasons of rigidity. For example, the screen according to the present invention, typical size range for the screen perforations may be, for example, between approximately 1 and 20 mm and method such as punching or laser cutting can be utilized. As a rule, this results in lower costs than would occur with drilling. Additional methods to produce the perforations are, for example, milling, water jet cutting, etching, eroding, electrochemical drilling, forming of flow holes or broaching.

Screen perforations can also be produced whose cross sections are not rotationally symmetrical: i.e. elongated holes, rectangles, diamonds, hexagons or other polygons with rounded corners. This can offer special advantages in wet screening of fibrous stock suspensions.

The screen perforations according to the present invention may enlarge in the direction of flow of the liquid to be screened. This can be implemented with cylindrical holes or also with cross sections deviating from such.

In order to achieve a sufficient effect, a part, for example, approximately half, of the screen perforations should enlarge, for example, conically toward the inflow side. However, non-sequential enlargements can also be formed. This increases the turbulence on the inflow side of the screen which leads to an increase in the throughput. Additional turbulence generators on the screen surface, for example in the form of disturbance strips, can therefore be foregone, which results in cost and energy savings.

In the interest of minimal production expenditure the inflow side should be cylindrical in shape on a part, for example on half, of the screen perforations.

In regard to the production and the screening effect the screen perforations may have a circular cross section.

For most applications the smallest cross sectional area of the screen perforations may be between approximately 0.5 and 700 $mm^2$, or between approximately 3 and 300 $mm^2$.

The screen perforations should moreover be arranged uniformly, for example in several parallel rows of screen perforations located adjacent to each other. For a comprehensive effect of the conical screen perforations, the screen perforations may alternate with cylindrical and conical inflow side in one row and/or if the screen perforations are arranged in rows of screen perforations located adjacent to each other extending vertical to each other.

In order for the conical screen perforations to be effective, the cross sectional area of the conical screen perforations may enlarge by approximately 100 to 400% or by approximately 200 to 300% toward the inflow side and/or if the depth of the cone of the screen perforation on the inflow side may be between approximately 0.5 and 5 mm on the inflow side.

Typically screens of this type are flat; however cylindrical screen baskets are also feasible.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
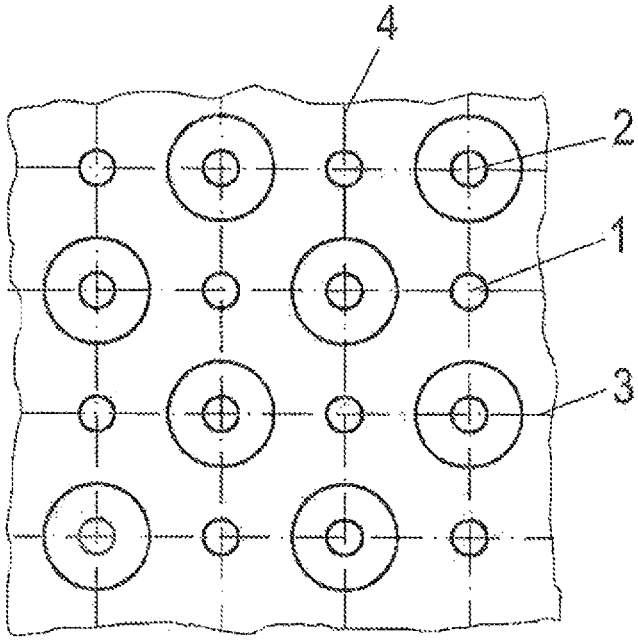
FIG. 1: is a top view onto a screen section according to the present invention.

Referring now to the drawings, and more particularly to FIG. 1, there is shown a screen perforations 1, 2 are arranged in several parallel rows whereby, in this example, screen perforations 1, 2 form horizontal rows 3 and at the same time also vertically extending rows 4. In this arrangement all adjacent screen perforations 1, 2 are located the same distance from each other which ensure effective utilization of the screen area at high stability.

The screen has circular screen perforations 1 whose inflow side 5 is cylindrical in shape and circular screen perforations 2 which enlarge conically toward inflow side 5. The conical enlargement increases the turbulence on the screen surface and thereby improves the throughput. In order to attain this effect with an as large an open screen area as possible conical and cylindrical screen perforations 1, 2 alternate in one row 3, 4.

Figure 2:
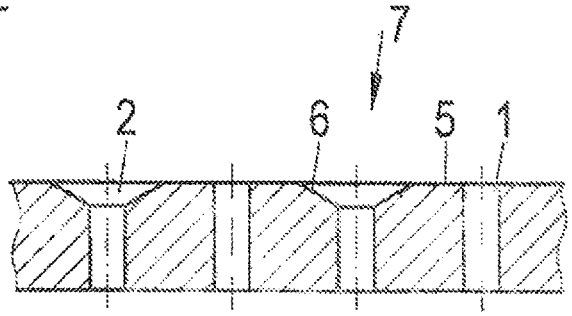
FIG. 2: is a partial cross section through a screen according to the present invention.

The fibrous stock suspension flows through the screen from inflow side 5 whereby the screen in this example is flat as can be seen in FIG. 2. Larger contaminants are hereby held back and may be removed on the inflow side 5 for example by a scraper.

The thickness of the screen in this example is between 6 and 30 mm and cone 6 of screen perforations 2 has a depth of 0.5 to 5 mm. The smallest diameter of screen perforations 1, 2 which is decisive for the screening effect is between 0.8 and 30 mm.

In the embodiment according to FIG. 2, cylindrical screen perforations 1 have the same cylindrical cross section across the entire thickness of the screen. This can however be increased toward the outlet side if required.

Also with conical screen perforations 2, a cylindrical segment, which can also be enlarged, follows in flow direction 7 after cone 5.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A screen for treating a fibrous stock suspension for producing a fibrous material web, the screen comprising a plurality of perforations, each of said plurality of perforations having a cross sectional area which has a smallest section with a size which is substantially the same, and at least some of said perforations including an inflow side having a cross-sectional area with a different size from one said perforation to another.

2. The screen according to claim 1, wherein a portion of said plurality of perforations enlarges toward said inflow side of the screen.

3. The screen according to claim 2, wherein said portion is approximately half of said plurality of perforations.

4. The screen according to claim 2, wherein said portion of said plurality of perforations enlarges conically toward said inflow side of the screen.

5. The screen according to claim 1, wherein said inflow side of a portion of said plurality of perforations is cylindrical in shape.

6. The screen according to claim 5, wherein said inflow side of half of said plurality of perforations is cylindrical in shape.

7. The screen according to claim 1, wherein said plurality of perforations have a circular cross section.

8. The screen according to claim 1, wherein said cross sectional area of said smallest section of each of said plurality of perforations is between approximately 0.5 and 700 millimeters square ($mm^2$).

9. The screen according to claim 8, wherein said cross sectional area of said smallest section of each of said plurality of perforations is between approximately 3 and 300 $mm^2$.

10. The screen according to claim 1, wherein said plurality of perforations are arranged uniformly.

11. The screen according to claim 10, wherein said plurality of perforations are arranged in a plurality of parallel rows located adjacent one another.

12. The screen according to claim 11, wherein said plurality of perforations have a shape which alternates between a cylindrical shape and a conical shape in one of said plurality of parallel rows.

13. The screen according to claim 11, wherein said plurality of perforations are arranged in a plurality of rows located adjacent to each other and extending vertical to each other.

14. The screen according to claim 4, wherein said portion of said plurality of perforations which enlarge conically toward said inflow side enlarge by 100 to 400%.

15. The screen according to claim 14, wherein said part of said plurality of perforations which enlarge conically towards said inflow side enlarge by 200 to 300%.

16. The screen according to claim 1, wherein the screen has a thickness between 6 and 30 mm.

17. The screen according to claim 4, wherein a depth of a cone part of said plurality of perforations conically enlarging toward said inflow side is between approximately 0.5 and 5 mm.

18. The screen according to claim 1, wherein the fibrous material web is one of a paper, cardboard and tissue web.

* * * * *